US006836222B1

(12) United States Patent
Carini

(10) Patent No.: US 6,836,222 B1
(45) Date of Patent: Dec. 28, 2004

(54) TAXIWAY BARRICADE SYSTEM

(75) Inventor: John J. Carini, Midlothian, VA (US)

(73) Assignee: Sherwin Industries, Inc., Milwaukee, WI (US)

( * ) Notice: Subject to any disclaimer, the term of this patent is extended or adjusted under 35 U.S.C. 154(b) by 78 days.

(21) Appl. No.: 09/896,801

(22) Filed: Jun. 29, 2001

(51) Int. Cl.[7] ..... G08G 1/095

(52) U.S. Cl. ..... 340/908.1; 340/907; 340/908; 340/947; 256/6; 256/13.1

(58) Field of Search ..... 340/908.1, 953, 340/947, 954, 956, 907, 9; 362/132, 152, 126, 219, 84; 116/63 R, 63 P, 63 C; 256/1, 13.1; 404/6, 11, 12

(56) References Cited

U.S. PATENT DOCUMENTS

| | | | | | |
|---|---|---|---|---|---|
| 2,907,998 | A | | 10/1959 | Conly | |
| 3,883,846 | A | | 5/1975 | Bruner | |
| 4,087,785 | A | | 5/1978 | Dodich | |
| 4,090,472 | A | * | 5/1978 | York | 119/502 |
| 5,122,797 | A | | 6/1992 | Wanasz | |
| D332,233 | S | | 1/1993 | Batts | |
| 5,453,916 | A | * | 9/1995 | Tennis et al. | 362/152 |
| 5,641,241 | A | * | 6/1997 | Rushing | 404/6 |
| 5,661,474 | A | * | 8/1997 | Douglas | 340/940 |
| 5,688,041 | A | * | 11/1997 | Arndt | 362/226 |
| 5,751,226 | A | | 5/1998 | Hretsina | |
| 5,986,581 | A | * | 11/1999 | Magdaleno, II et al. | 340/953 |
| 6,082,867 | A | * | 7/2000 | Chien | 362/84 |
| 6,135,423 | A | * | 10/2000 | Johnson | 256/1 |
| 6,259,375 | B1 | * | 7/2001 | Andras | 340/907 |
| 6,450,677 | B1 | * | 9/2002 | Knauer et al. | 362/551 |

OTHER PUBLICATIONS

Advertisement, *CALKIT—Civil Airfield Lighting System,* Airport International, p. 12 (May 2000).

*CALKIT, Metalite's Portable, Trailer Mounted Civil Airfield Lighting System,* http://www.metaliteaviation.com.

Brochure, *Portable Lighted Runway Closure Marker Day or Night* (date unknown).

* cited by examiner

*Primary Examiner*—Davetta W. Goins
(74) *Attorney, Agent, or Firm*—Boyle Fredrickson Newholm Stein & Gratz S.C.

(57) ABSTRACT

A barricade system includes supports positioned in a spaced-apart fashion across a path to be closed. A lightable rope is fastened to the supports to close the path to vehicular traffic. The lightable rope is energizable by a single electrical power source such as a generator or an electrical outlet. The components of the system can be stowed and transported on a trailer or the like, making the system very portable. The barricade system is particularly suited for use in closing airport taxiways, in which case it warns pilots that a taxiway is closed and prevents entry onto the taxiway. The entire system (or at least those parts of it that are placed on the taxiway) also is sufficiently frangible to permit its use as a taxiway barricade system.

33 Claims, 6 Drawing Sheets

TAXIWAY BARRICADE SYSTEM

FIELD OF THE INVENTION

The invention relates to barricade systems that close paths to vehicular traffic and that are powered by a single power source. In particular, the invention relates to systems for closing airport taxiways or similar paths and to methods for their use.

DESCRIPTION OF THE RELATED ART

Aircraft take-off and land on runways at airports. Taxiways are routes that lead aircraft to runways before flight take-off and direct landed aircraft to the airport terminal, a hanger, or another location that is spaced from the runway. Periodically, taxiways must be closed, for example, for servicing and resurfacing the taxiway. Warning signals or barricade systems are typically erected to indicate to pilots that a taxiway is closed.

For instance some airports barricade closed taxiways using an unsophisticated taxiway barrier system comprising low railroad ties or concrete barriers in combination with lights or reflectors mounted on the barriers. These systems are heavy and difficult to transport, install, and remove. Moreover, any airplane that runs into them is likely to suffer nose and propeller damage.

A more sophisticated taxiway barricade system includes individual beacon lights placed across the taxiway at spaced-apart locations to barricade a taxiway. The beacon lights are transported to and from the taxiway via a specially designed trailer. While this type of system is more effective at barricading a taxiway than a trailer-mounted light, it is difficult to put in place and to operate. Each of the beacon lights is powered by an individual battery, which is heavy and requires frequent recharging or replacing. This independent power requirement discourages the use of true taxiway barricades.

Another type of warning device, used only on runways, comprises a large, X-shaped, illuminated warning signal that is mounted on a trailer that is towed to the area of the runway to be closed. The X-shaped marker is then erected and illuminated to indicate to pilots that entry is not permitted onto the runway. While this type of sign is useful to warn pilots that entry is prohibited, it does not provide a true barricade to entry. It also cannot be used on taxiways because Federal Aviation Administration (FAA) rules require that taxiway barricade systems must be sufficiently frangible that they are knocked over or destroyed by contact with a rotating propeller without damaging the propeller. A trailer-mounted X-shaped marker does not meet this requirement.

Thus, there is a need for a taxiway barricade system that combines the benefits of a warning system with the benefits of a barricade system. In particular, the taxiway barricade system should be easily portable and easy to assemble and disassemble. The taxiway barricade system should also be a good barricade to prevent entry of aircraft. Furthermore, the barricade system should be energizable by a single power source.

SUMMARY OF THE INVENTION

The invention, which is defined by the claims set out at the end of this disclosure, is intended to solve at least some of the problems noted above. It is also applicable in applications other than taxiways, in which there is a need to block a path from vehicular traffic.

In accordance with a first aspect of the invention, a barricade system includes supports which are positioned in a spaced-apart fashion on a path to be closed and a lightable rope which is fastened to the supports to close the path to vehicular traffic. The lightable rope is energizable by a single electrical power source. The single power source eliminates the need for hauling heavy batteries to the barricade and the need for replacing dead batteries. The electrical power source preferably is either a generator or an electrical outlet. The entire system (or at least those parts of it that are placed on the taxiway) is sufficiently frangible to permit its use as a taxiway barricade system.

A method of closing a path is also provided. Supports are positioned across a path in a spaced-apart fashion. A lightable rope is fastened to the supports to close the path to vehicular traffic. The lightable rope is energized with an electrical power source. When the path is to be opened to vehicular traffic, the lightable rope is de-energized, the lightable rope is removed from the supports, and the supports are removed from the path.

The barricade system provided herein combines the benefits of both a warning system and a barricade system to prevent entry of aircraft. If desired, the barricade system can be rendered highly transportable by configuring it to be easily stowed on a trailer, a pickup truck, or the like. The barricade system is also easy to set up and to remove.

BRIEF DESCRIPTION OF THE DRAWINGS

Preferred exemplary embodiments of the invention are illustrated in the accompanying drawings, in which like reference numerals represent like parts throughout and in which.

Figure 2:
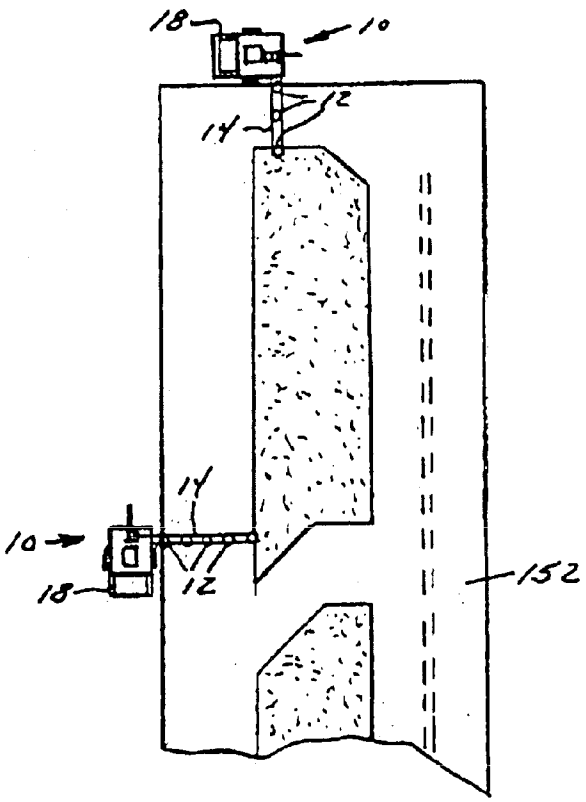
FIG. 2 is a schematic top view of a portion of the airport of FIG. 1 in which one of the taxiways is barricaded by a barricade system constructed in accordance with the invention.

Before explaining embodiments invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION

1. Resume

Pursuant to the invention, a barricade system is provided that includes supports which are positioned in a spaced-apart fashion-across a taxiway or other path to be closed. A lightable rope is fastened to the supports when the barricade system is in use. The lightable rope is energizable by a single electrical power source. The supports and lightable rope close the path to vehicular traffic and provide a warning to vehicular operators that the path is closed. The entire system (or at least those parts of it that are placed on the taxiway) also is sufficiently frangible to permit its use as a taxiway barricade system.

2. System Overview

The taxiway barricade system described herein can be used to close a variety of paths to vehicular traffic. The term "path" as used herein includes, but is not limited to, a taxiway, a road, a street, a highway, an alleyway, or any other path on which airplanes, automobiles, or other vehicles travel. A preferred embodiment of the invention will be described in use as an airport taxiway barrier system. This example is not intended to limit the invention to barricade systems usable only taxiways.

Figure 1:
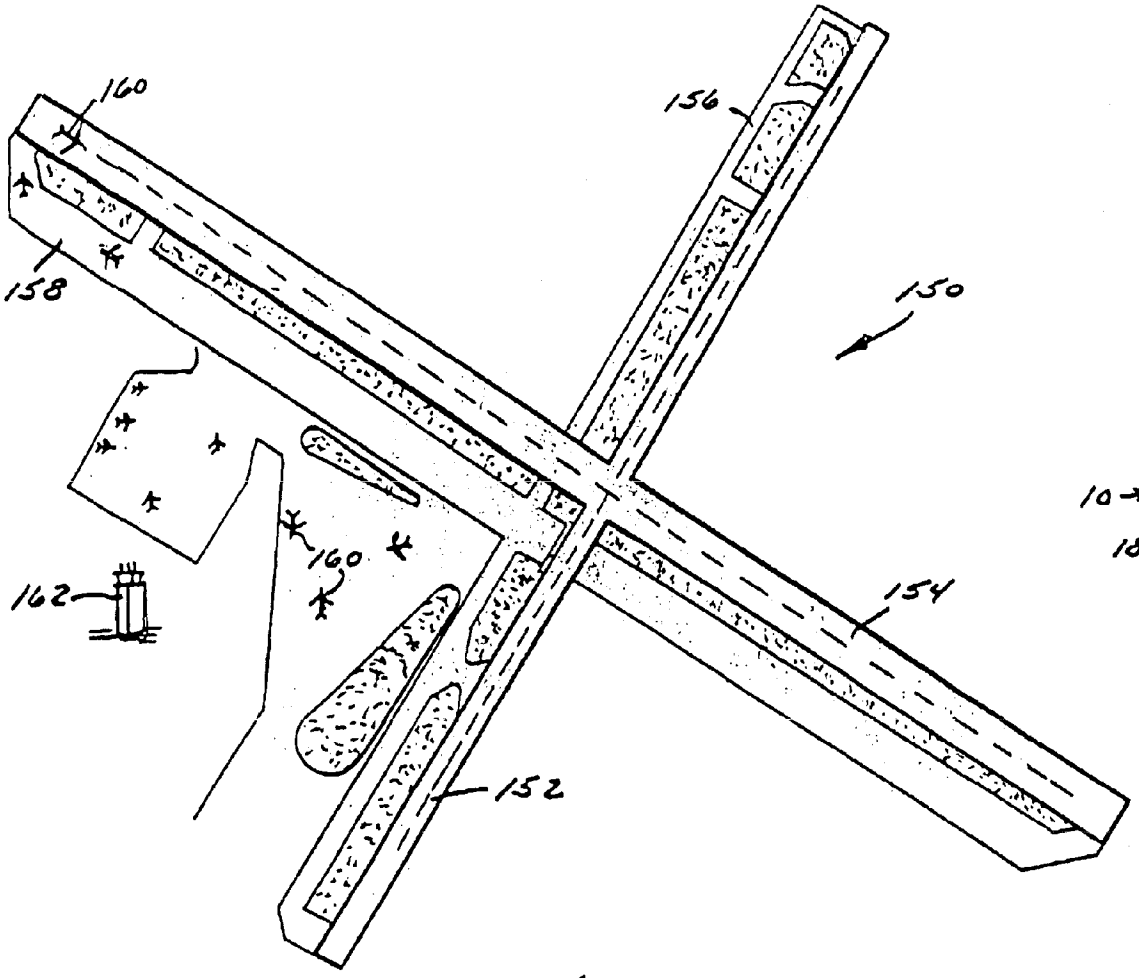
FIG. 1 is a schematic top plan view of an airport with two runways, each runway having a taxiway on which a taxiway barricade system can be erected.

FIG. 1 illustrates a small airport 150 with two runways 152 and 154. A taxiway 156, 158 is located at an edge of each runway 152, 154. Each taxiway leads aircraft 160 to the runway before take-off and leads aircraft 160 to a terminal area 162 or another location after landing. When a taxiway (e.g., taxiway 156) needs to be closed, the taxiway barricade system 10 provided herein is erected at one or more locations on the taxiway as is illustrated in FIG. 2.

Figure 3:
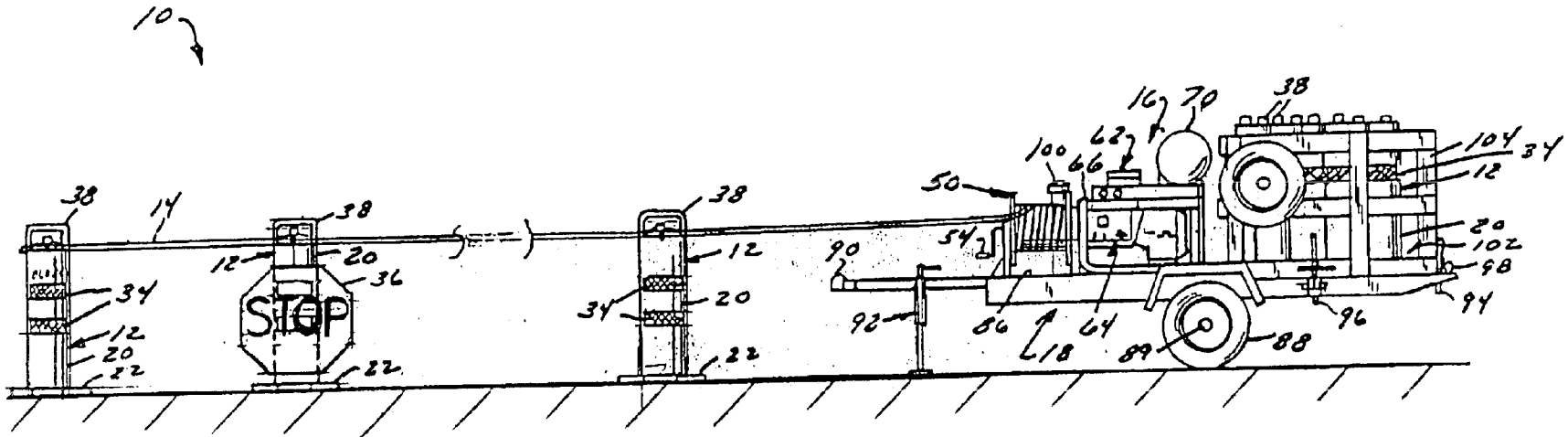
FIG. 3 is a side elevation view of the barricade system of FIG. 2, showing support stanchions, a lightable rope, a generator, a controller, and an optional trailer for carrying the system components.

A preferred embodiment of the taxiway barricade system 10 is illustrated in FIG. 3. The taxiway barricade system 10 includes 1) supports 12 which are positioned in a spaced-apart fashion on the taxiway 154 to be closed and 2) a lightable rope 14 which is fastened to the supports 12 when the barricade system 10 is in use, hence, barricading the taxiway. The rope 14 is supplied with electrical power from a single power source 16. The lightable rope 14 provides a warning to pilots that the taxiway 154 is closed. Additionally, the lightable rope 14, in combination with the supports 12, provides a barrier against entry onto the taxiway. The components of the barricade system 10 can be transported to and from the taxiway via a trailer 18, which may also support the power source 16.

Figure 5:
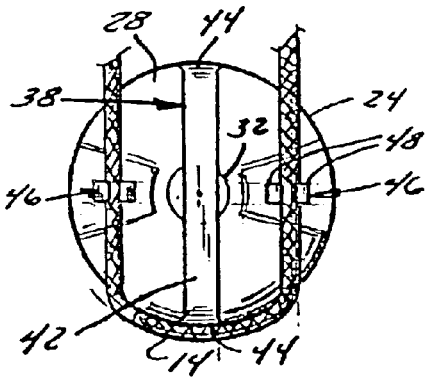
FIG. 5 is a top plan view of the support stanchion of FIG. 4.
Figure 4:
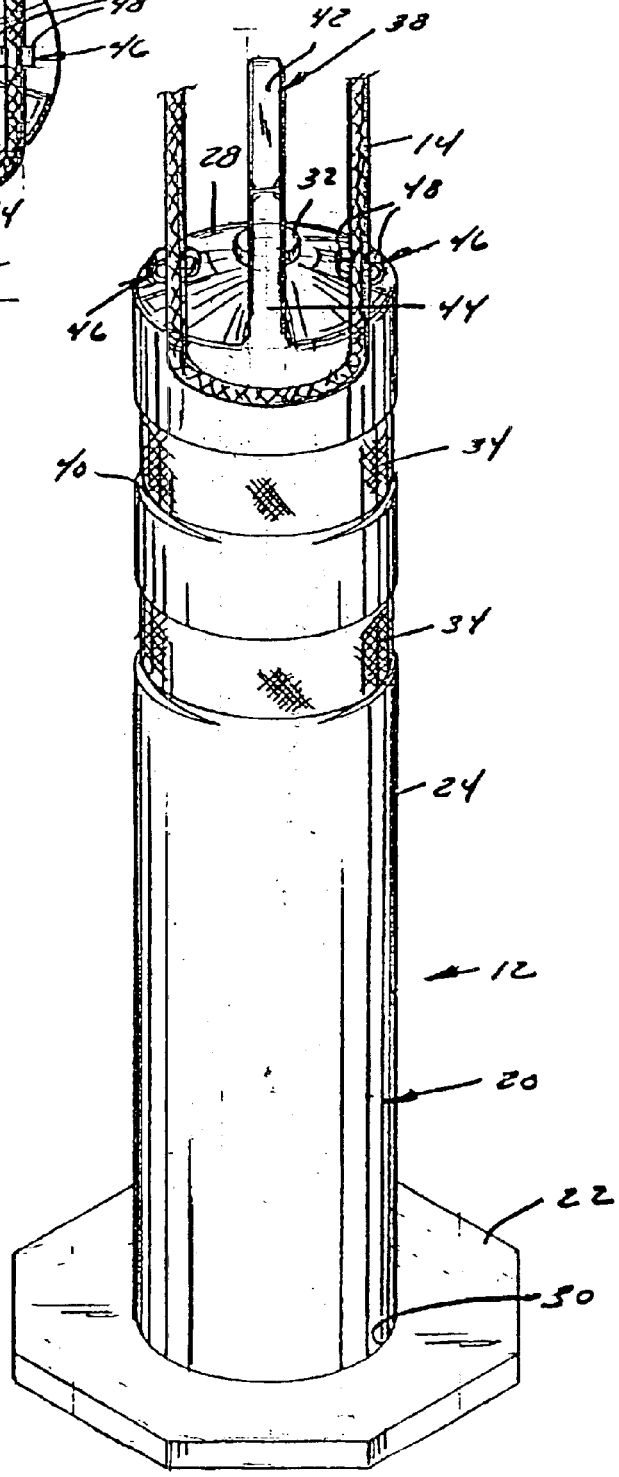
FIG. 4 is a perspective view of a support stanchion of FIG. 3.

As can best be seen in FIGS. 4 and 5, the supports 12 may comprise any portable structure capable of supporting the lightable rope 14. In the illustrated embodiment, the supports include stanchions 20 having removable bases 22. Each stanchion 20 is hollow and includes a cylindrically-shaped sidewall 24 and a top 28 which is preferably integral with the sidewall 24. Each base 22 is a planar, hexagonally-shaped structure with a throughhole 30 at its center. The six corners of the base 22 engage points on the sidewall 24 of the stanchion 20 to hold the stanchion 20 in place. In order to prevent the stanchions 20 from toppling, they are weighted by filling them with water, sand, or any other weighted material. The base 22, being relatively heavy (typically on the order of 16 lbs.), provides additional support for the stanchions 20. The interior of each stanchion 20 may be accessed for this purpose by removing a cap 32 on top 28 of the stanchion 20.

Several attributes of the stanchions 20 make the stanchions 20 highly visible such that pilots are warned of a taxiway closure. First, the color of the stanchions 20 preferably is yellow or any color that is highly visible during the daylight. Second, at least a portion of the outer surface of the stanchions 20 includes a reflective material to further illuminate the stanchions 20 when they are struck by a light source. Typically, two reflective bands 34 that are two to four inches wide are placed around the stanchion 20. A preferred reflective band is a 3M® reflective band. Third, if desired, signage, such as stop signs 36 (shown in FIGS. 3 and 11), may be detachably or permanently mounted onto one or more of the stanchions 20 to provide further warning to pilots that the taxiway is closed. Messages, such as AIRCRAFT MOVEMENT AREA, STOP, DO NOT ENTER, VIOLATORS WILL BE PROSECUTED, can be added to the signs to further warn pilots and others that the taxiway is closed.

The stanchions 20 are also designed to maximize ease of transport. Hence, they are made of a relatively lightweight materials, such as a blow molded plastic. Handles 38 and indentations 40 are included. Referring back to FIGS. 4 and 5, the handles 38, preferably comprise inverted U-shaped members extending from the tops 28 of the stanchions 20. Each handle 38 has a horizontal portion 42 and two vertical legs 44, one of which extends at a right angle from each end of the horizontal portion 42. The legs 44 are connected to the top 28 of the stanchion 20, and preferably are molded integrally with it. Preferably, the stanchions 20 also include one or more indentations 40 on opposite sides of the cylindrical sidewall 24 that permit a user to lift the stanchion 20 by grasping it at the indentations 40.

Opposed clips 46 are mounted on top 28 of each stanchion 20 for gripping the lightable rope 14 as can best be seen in FIGS. 4 and 5. Preferably, the clips 46 are spring-load clips that are made of spring-steel or vinyl. Each clip 46 includes two C-shaped arms 48 that are spaced apart at a distance that is slightly less than the diameter of the lightable rope 14. The arms 48 are biased toward each other to secure the rope 14 in place. The lightable rope 14 is removed from the clips 46 by pressing the arms 48 of the clips 46 away from each other to enlarge the distance between the arms 48.

The rope 14 may comprise any lightable rope that can withstand multiple windings and unwindings and that will not loosen on a reel 50, which is discussed in detail below and on which the rope 14 can be held. The preferred lightable rope 14 comprises a tubing that includes multiple, space-apart lights positioned along the length of the tubing and that is coupled to the single electrical power source 16 as described in detail below. A preferred lightable rope 14 is Flexible Neon Rope-brand lightable rope, which is sold by Neon-Design A-Sign of Laguna Niguel, Calif. Flexible Neon Rope is a 120 volt, illuminated flexible neon rope with ½ watt incandescent bulbs that are rated at 20,000 hours and that are preferably red in color. The bulbs are spaced along the length of the inside of the tubing. The tubing may be either ½" or ⅜" in diameter, and is a neon-colored polyvinyl chloride tubing that is impact and water-resistant. Illumination of the lightable rope 14 provides a warning to pilots that the taxiway is closed. Additionally, the lightable rope 14, in combination with the supports 12, provides a barrier against entry onto the taxiway.

Figure 9:
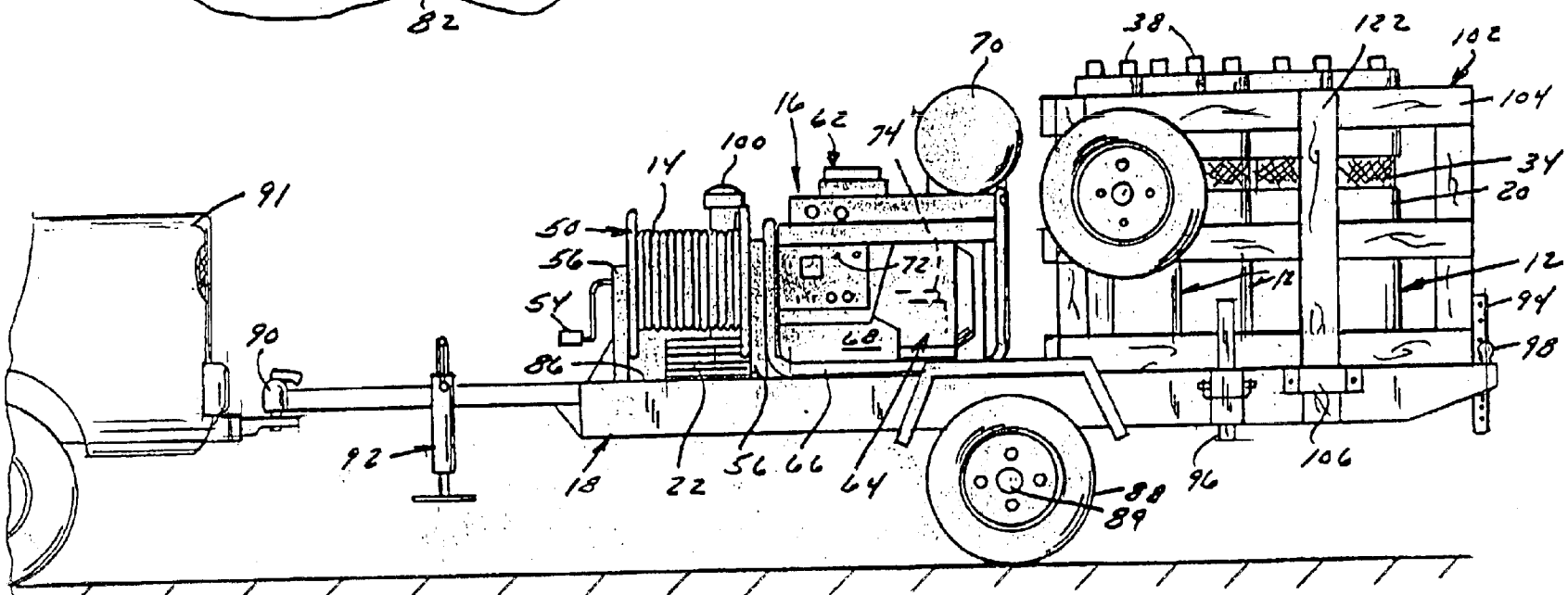
FIG. 9 is a side elevation view showing the taxiway barricade system of FIG. 3 in a stowed condition thereof.
Figure 10:
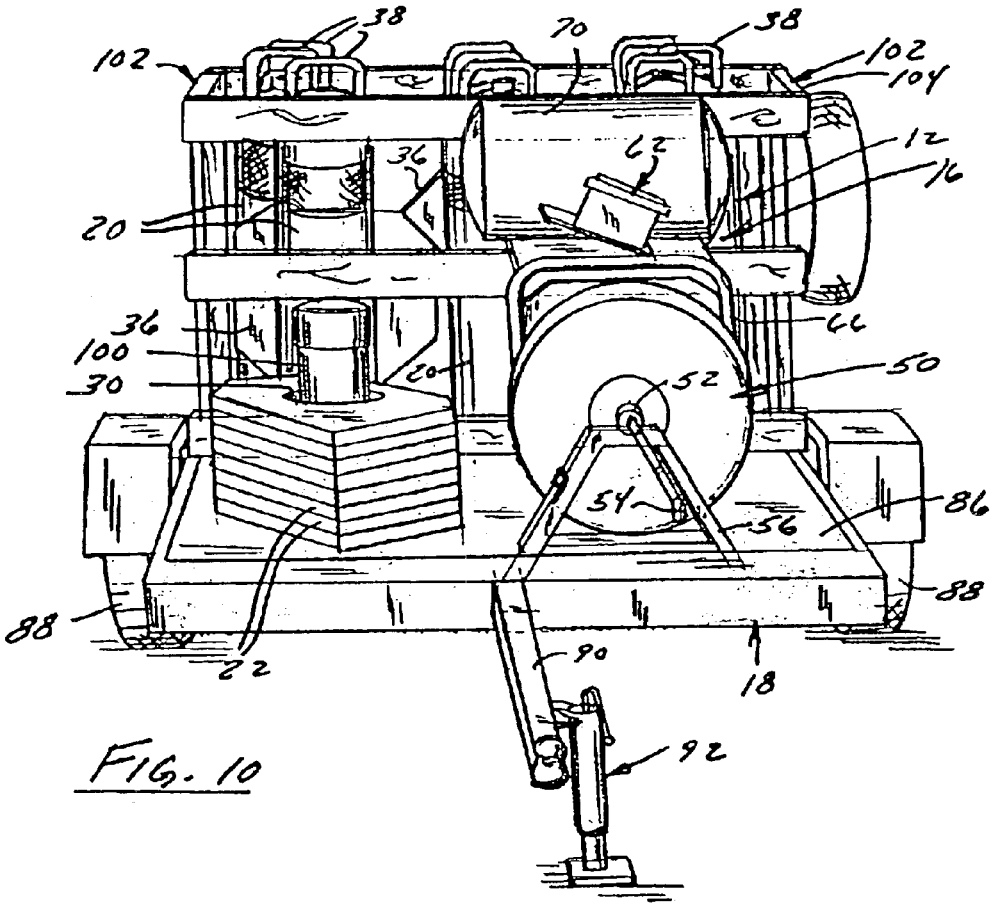
FIG. 10 is a front elevation view of showing taxiway barricade system of FIG. 3 in its stowed condition.

The rope 14 preferably can be wound onto the reel 50, best seen in FIGS. 9 and 10. The reel 50 is mounted at the front of the trailer 18 for easy access and operation. The reel 50 is large enough to hold 150 feet of the lightable rope 14. It includes a hub 52 on which the lightable rope 14 is retained when it is not in use. The reel 50 also includes a crank 54, a manually operated lock (not shown), and a base 56. The crank 54 can be turned to wind and unwind the rope 14 onto and from the reel 50. The lock prevents unauthorized unwinding of the rope 14. The base 56 comprises metal struts that support the reel 50 on the trailer 16 such that the reel 50 can be turned without interference from the surface below the reel 50. A bracket (not shown) is located on the base 56 of the reel 50 and retains a free end of the lightable rope 14 when the rope 14 is wound on the reel 50.

The lightable rope 14 is electrically coupled to the reel 50 such that energizing an outlet 53 on the reel 50 energizes the lightable rope. At the center of the reel 50 is a first power cord 60 that electrically couples the lightable rope 14 to a controller 62, which is described in detail below. When the first power cord 60 is unplugged from the reel 50, the first power cord 60 can be secured via a hold down clip (not shown).

The power source 16 may comprise an outlet (not shown) located in the vicinity of the reel 50. In applications in which such an outlet is unavailable, the electrical power source may comprise a generator 64 mounted on the trailer 18 behind the reel 50 as illustrated in FIG. 9. A preferred generator 64 is a 2,700 watt Yanmar® diesel-powered generator. Now referring to FIGS. 7 and 9, the generator 64 includes a frame 66, an engine/generator housing 68, a fuel tank 70, an ON/OFF switch 72, and an internal combustion engine 74. The fuel tank 70 holds enough fuel to power the generator 64 for at least 24 hours, and preferably for 32 hours or more.

Figure 7:
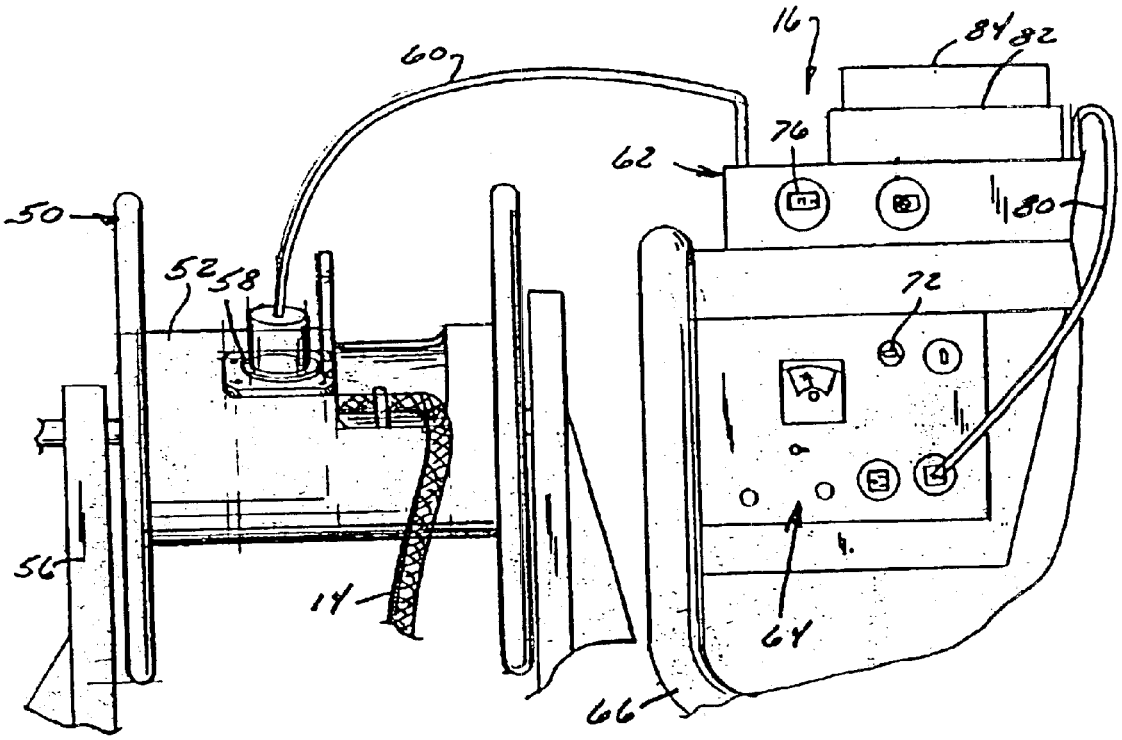
FIG. 7 is side elevation view of the reel of FIG. 6 and the controller for regulating the generator.
Figure 8:
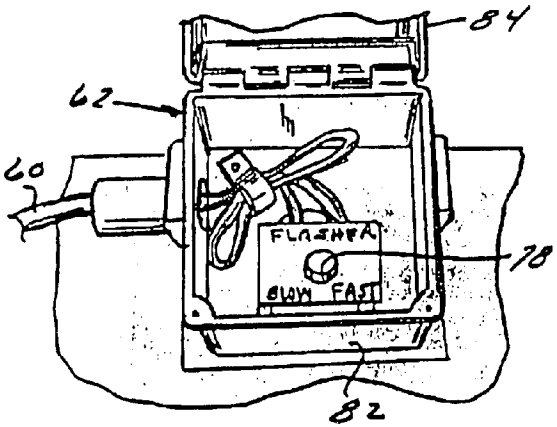
FIG. 8 is a fragmentary perspective view of the controller of FIG. 3.

Now referring to FIGS. 7 and 8, the controller 62 regulates the supply of electrical power source 16. The controller 62 is mounted on top of the generator 64 for easy access and operation. The controller 62 includes an ON/OFF switch 76 and a control knob 78. It is coupled to the reel 50 by the above-mentioned first power cord 60 and to the generator 64 by a second power cord 80. The controller 62 is mounted in a weatherproof box 82 that is preferably is made of plastic and that has a hingedly attached cover 84. For further protection, a protective sheet (not shown) can be used to cover the controller 62, the generator 64, and the reel 50 during system transport and storage.

The controller 62 is wired or programmed such that suitable manipulation of the knob 78 alters the frequency and/or duration of the illumination of the lightable rope 14 such that the lights flash at a desired frequency or are illuminated in a chaser fashion of a desired rate. This intermittent illumination provides a further warning signal to pilots that the taxiway is closed. It also provides enhanced visualization at night.

Figure 11:
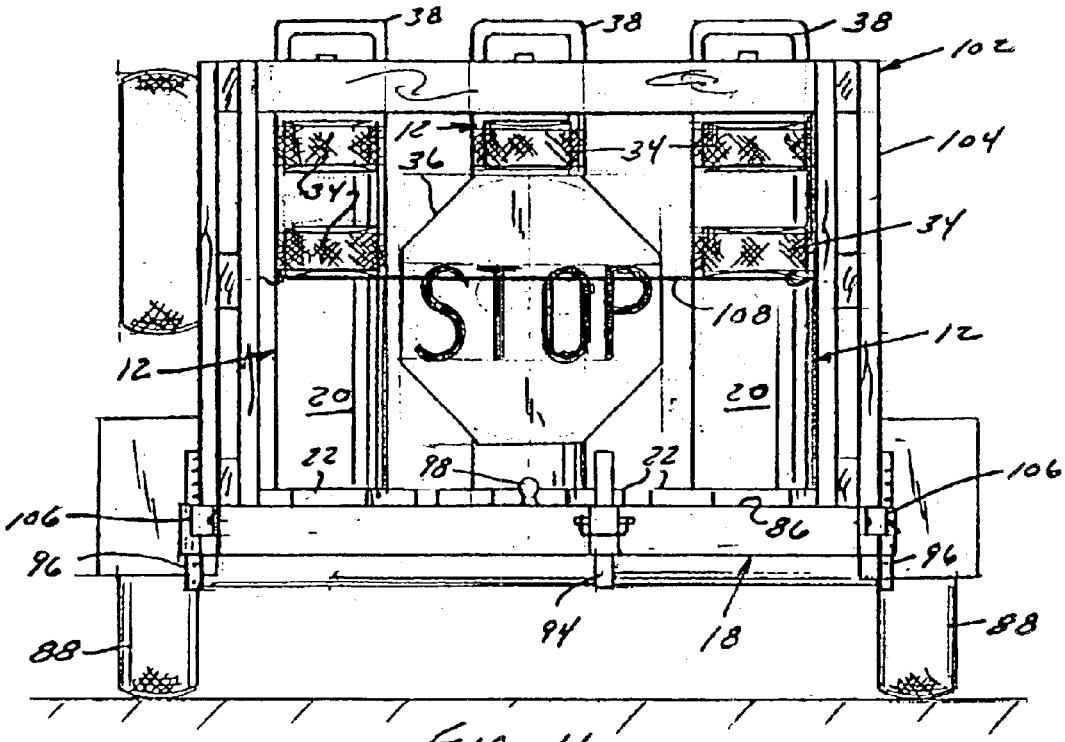
FIG. 11 is a rear elevation view showing a storage area on the trailer for holding the support stanchions.

Referring now to FIGS. 9–11, the trailer 18 is configured to be towed by a vehicle and to stow and transport the barricade system 10. It is preferably about 4 feet wide and 8 feet long. It includes a floor surface 86 on which items are carried or mounted, wheels 88 and an axle 89 on which the floor 86 is supported, a front hitch 90 that is mountable to a towing vehicle 91, and front, rear, and side jacks 92, 94, 96 (FIG. 11) for stabilizing the trailer 18 when it is parked. An additional hitch 98 can be included at the rear of the trailer 18 to permit attachment of a second trailer 18, hence permitting multiple barricade systems 10 to be transported by a single vehicle. The trailer 18 also includes standard safety chains and trailer light cords (not shown). It also includes a post 100 for supporting the bases 22 and a storage area 102 for storing the stanchions 20. Alternatively, the bases 22 could be stored directly on the stanchions 100.

The jacks 92, 94, and 96 support the trailer 18 after the barricade system 10 is transported to a desired location and stabilize the trailer 18 during generator 64 operation. When they are not in use, they can be raised, such as pivoting relative to their mounts, or moving vertically relative to brackets that support them.

Figure 6:
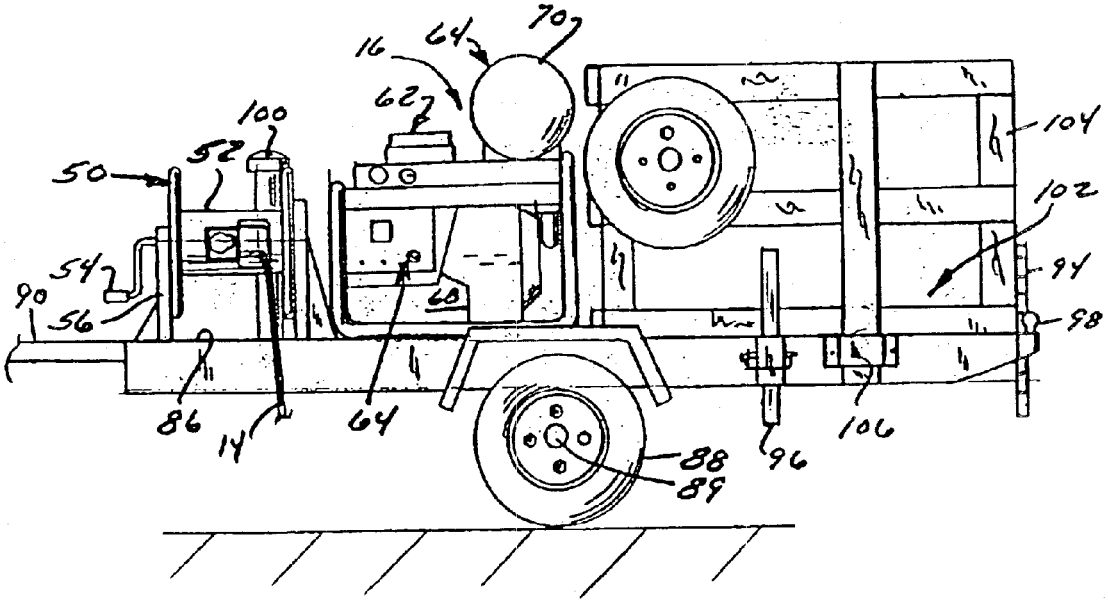
FIG. 6 is a side elevation view of the trailer that supports a generator and a reel of the barricade system.

As can be seen in FIGS. 6, 7, and 10, the post 100 extends upwardly from the floor surface 86 of the trailer 18 at a location in front of the reel 50. The bases 22 are stacked on the post 100 at their throughholes 30. The storage area 102 is located behind the generator 64. Three of the sides of the storage area 102 are bordered by fences 104, which preferably are about 30 inches tall and removably held in place by straps 106. The fourth, rear, side is bordered by a removable chain, rope, or the like 108, which can be opened to allow the stanchions 20 to be easily moved to and from the trailer 18.

3. Operation of the Taxiway Barricade System

In use, the trailer 18, carrying the supports 12, lightable rope 14, power source 16, and controller 62, is hitched to a towing vehicle 91 and towed to the area in the taxiway 154 which is to be barricaded. The trailer 18 is parked near the edge of the taxiway 154. The front, side, and rear jacks 92, 94, 96 are lowered and locked in place as is shown in FIGS. 9–11 to stabilize the trailer 18. Wheel chocks (not shown) can be used in front of and behind the wheels 88 of the trailer 18 to prevent it from rolling. The towing safety chains and trailer light cord (not shown) are disconnected. The hitch 90 is then released from the towing vehicle 91.

The bases 22 are removed from the trailer post 100 on which they were stacked, and the stanchions 20 are removed from the storage area 102 of the trailer 18. The stanchions 20 are placed on the bases 22 and are positioned across the taxiway 156 in a spaced-apart fashion as seen in FIGS. 2 and 3.

The protective sheet (not shown) is removed from the generator 64, the reel 50, and the controller 62. The reel 50 is unlocked, part or all of the length of the lightable rope 14 is unwound from the reel 50, and the lightable rope 14 is installed on the stanchions 20 at the clips 46. If the length of lightable rope 14 used is equal to (or less than) the distance that the supports 12 span, the rope 14 is fastened to only one clip 46 on each stanchion 20. If a longer length of rope 14 is used, then, at the last stanchion 20, the remainder of the rope 14 is looped back toward the beginning of the rope 14, and the remaining length of rope is fastened in the second clip 46 as is shown in FIGS. 5 and 6. This doubles the amount of the lightable rope 14 for at least a portion of the lightable rope 14 and provides greater visibility. If desired, signs 36 such as stop signs are positioned on the supports 12 to provide further warning to pilots that the taxiway is closed.

The second power cord 80 is plugged into the generator 64 to couple the controller 62 to the generator 64. The lightable rope 14 is then energized by starting the generator 64 according to manufacturer's recommendations, including turning the switch 72 to its ON position. The first power cord 60 is then plugged into center of the reel 50 to couple the lightable rope 14 to the controller 62. If desired, the frequency, duration, or other parameter of the illumination is adjusted using the controller 62.

To stow the taxiway barrier system 10, the lightable rope 14 is de-energized by turning the power switch 72 on the generator 64 to its OFF position. The controller cover 84 is closed. The lightable rope 14 is released from the clips 46 on the stanchions 20. The stanchions 20 are moved to and stowed on the storage area 102 of the trailer 18. The bases 22 are placed on the post 100 of the trailer 18.

The reel 50 is unlocked, and the lightable rope 14 is wound onto the reel 50. The free end of the lightable rope 14 is secured in the bracket at the base 56 of the reel 50 to prevent damage to the lightable rope 14 during transportation and storage.

After the generator 64 cools down, the protective sheet is placed over the generator 64 and the reel 50. All stanchions 20 and bases 22 are secured on the trailer 18 before towing. All jacks 92, 94, 96 are released and secured. The trailer 18 is hitched to the lowing vehicle 89, safety chains are secured, and appropriate light connections are made. The taxiway barrier system 10 is then ready for transportation.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention.

The invention is not intended to be limited to the preferred embodiments described above, but rather is intended to be limited only by the claims set out below. Thus, the invention encompasses all alternate embodiments that fall literally or equivalently within the scope of these claims.

What is claimed is:

1. A barricade system for an airport taxiway comprising:

(A) supports which arm positionable in a spaced-apart fashion across the airport taxiway to be closed and which comprise stanchions and bases which hold the stanchions; and (B) a lightable rope which is fastenable to the supports to close the airport taxiway to vehicular traffic and which is energizable by a single electrical power source, wherein the supports and the lightable rope are sufficiently frangible that, when they ar contacted by a rotating propeller, they are knocked over or destroyed by the propeller without damaging the propeller.

2. A barricade system of claim 1, wherein the electrical power source comprises a generator.

3. A barricade system of claim 1, wherein the electrical power source comprises an electrical outlet.

4. A barricade system of claim 1, wherein the barricade system further comprises:

a trailer; and a reel which is carried by the trailer and on which the lightable rope can be retained, wherein, when the system is in use, the lightable rope includes a first end which is attached to one of the supports and a second end which is supported by the reel.

5. A barricade system of claim 1, wherein the stanchions arm removable from the bases.

6. A barricade system of claim 1, wherein the stanchions further comprise clips in which the lightable rope is selectively held.

7. A barricade system of claim 1, farther comprising a controller which regulates illumination of the ligatable rope.

8. A barricade system of claim 7, wherein the controller regulates a frequency of the illumination of the lightable rope.

9. A barricade system of claim 7, wherein the controller regulates a duration of the illumination of the lightable rope.

10. A barricade system of claim 1, further comprising a trailer which carries the supports and the lightable rope when the barricade system is not in use.

11. A barricade system for an airport taxiway comprising:

(A) supports which art positioned in a spaced-apart fashion across the airport taxiway; and (B) a lightable rope which is fastened to the supports to close the airport taxiway to vehicular traffic and which is energized by a single electrical power source, wherein the supports and the lightable rope are sufficiently frangible that, when they are contacted by a rotating propeller, they are knocked over or destroyed by the propeller without damaging the propeller.

12. A barricade system for an airport taxiway comprising:

(A) a trailer;

(B) supports which are carried on the trailer when the system is not in use and which, when in use, are positioned in a spaced-apart fashion on the airport taxiway to be closed; and (C) a lightable rope which is carried on the trailer when the system is not in use and which, when in use, is fastened to the supports to close the airport taxiway to vehicular traffic;

(D) a portable generator which is supported on the trailer and which supplies electrical power to the lightable rope when the system is in use; and (E) a reel which is carried by the trailer, wherein, when the system is in use, the lightable rope includes a first end which is attached to one of the supports and a second end which is supported by the reel, wherein the supports and the lightable rope are sufficiently frangible that, when they are contacted by a rotating propeller, they aye knocked over or destroyed by the propeller without damaging the propeller.

13. A system for closing an airport taxiway to vehicular traffic comprising:

(A) stanchions and bases which hold the stanchions, both of which are positioned in a spaced-apart fashion across the airport taxiway; and (B) a single illuminatable barricade which is fastened to all of the stanchions to close the airport taxiway to prevent vehicular traffic and is energized by an electric power source, wherein the stanchions and the lightable rope are sufficiently frangible that, when they are contacted by a rotating propeller they are knocked over or destroyed by the propeller without damaging the propeller.

14. A system for closing an airport taxiway to vehicular traffic comprising:

(A) a moveable platform;

(B) stanchions which are carried on the moveable platform when the system is not in use and which, when in use, are positioned in a spaced-apart fashion on the airport taxiway, (C) an illuminatable barricade which is carried on the moveable platform when the system is not in use and which, when in use, is fastened to all of the stanchions to close the airport taxiway to vehicular traffic;

(D) an electric power source which is carried on the moveable platform and which powers the illuminatable barricade;

(E) a controller which regulates the electric power source; and (F) signage carried by at least one stanchion, wherein the stanchions and the lightable rope are sufficiently frangible that, when they are contacted by a rotating propeller, they are knocked over or destroyed by the propeller without damaging the propeller.

15. A method of closing an airport taxiway comprising:

(A) positioning bases across the airport taxiway in a spaced-apart fashion;

(B) attaching stanchions to the bases;

(C) fastening a lightable rope to the stanchions to close the airport taxiway to vehicular traffic; and (D) energizing the lightable rope with a single electrical power source, wherein in the event of a rotating propeller hitting at least one of the rope and a stanchion, the part that is hit will break or be knocked over without damaging the propeller.

16. A method of claim 15, further comprising regulating the supply of electrical power to the lightable rope from the power source.

17. A method of claim 16, wherein the frequency of the illumination of the lightable rope is regulated.

18. A method of claim 16, wherein the duration of the illumination of the lightable rope is regulated.

19. A method of claim 15, further comprising:

(A) de-energizing the lightable rope;

(B) removing the lightable rope from the stanchions; and (C) removing the stanchions and the bases from the airport taxiway.

20. A method of claim 19, further comprising winding the lightable rope onto a reel.

21. A method of closing an airport taxiway comprising:

(A) positioning supports across the airport taxiway in a spaced-apart fashion;

(B) fastening a lightable rope carried on a reel to the supports to close the airport taxiway to vehicular traffic;

(C) electronically coupling the lightable rope to the reel; and (D) lighting the lightable rope with a single electrical power source, wherein in the event of a rotating propeller hitting at least one of the rope and a support, the part that is hit will break or be knocked over without damaging the propeller.

22. A method of closing an airport taxiway comprising:

(A) transporting a barricade system to the airport taxiway to be closed, the barricade system including:

(1) a trailer;

(2) supports which are carried on the trailer and (3) a lightable rope which is wound onto a reel on the trailer, (B) removing the supports from the trailer;

(C) positioning the trailer in a position spaced from the airport taxiway;

(D) positioning the supports across the airport taxiway in a spaced-apart fashion;

(E) unwinding the lightable rope from the reel; then (F) fastening the lightable rope to the supports to close the airport taxiway to vehicular traffic; and then (G) lighting the lightable rope with a generator mounted on the trailer when the trailer is spaced from the airport taxiway, wherein, in the event of an aircraft hitting at least one of the rope and a support the part that is hit will break or be knocked over without damaging the aircraft.

23. A method of claim 22, further comprising regulating the supply of electrical power to the lightable rope from the generator.

24. A method of claim 23, wherein the frequency of the illumination of the lightable rope is regulated.

25. A method of claim 23, wherein the duration of the illumination of the lightable rope is regulated.

26. A method of claim 22, wherein, during step (G), the trailer is located laterally adjacent the airport taxiway.

27. A method of claim 22, further comprising:

(A) de-energizing the lightable rope;

(B) removing the lightable rope from the supports;

(D) removing the supports from the airport taxiway; and (E) stowing the supports and the lightable rope on the trailer.

28. A system of claim 14, wherein the signage is permanently mounted to the stanchion.

29. A barricade system of claim 4, wherein the lightable rope is electrically coupled to the reel when the system is in use.

30. A barricade system of claim 12, wherein the lightable rope is electrically coupled to the reel when the system is in use.

31. A barricade system of claim 4, wherein, when the system is in use, the trailer can be positioned away from the airport taxiway.

32. A barricade system of claim 12, wherein, when the system is in use, the trailer can be positioned away from the airport taxiway.

33. A system of claim 14, wherein, when the system is in use, the platform can be positioned away from the airport taxiway.

* * * * *

UNITED STATES PATENT AND TRADEMARK OFFICE

CERTIFICATE OF CORRECTION

PATENT NO. : 6,836,222 B1
DATED : December 2, 2004
INVENTOR(S) : John J. Carini

It is certified that error appears in the above-identified patent and that said Letters Patent is hereby corrected as shown below:

Column 3,
Line 9, delete the dash between “fashion” and “across”;

Column 7,
Line 8, delete “lowing” and substitute therefor -- towing --.
Lines 24 and 48, delete “arm” and substitute therefor -- are --;
Line 32, delete “ar” and substitute therefor -- are --;
Line 52, delete “farther” and substitute therefor -- further --;
Line 64, delete “art” and substitute therefor -- are --;

Column 8,
Line 26, delete “aye” and substitute therefor -- are --;

Signed and Sealed this

Twenty-sixth Day of April, 2005

JON W. DUDAS
*Director of the United States Patent and Trademark Office*